United States Patent [19]

Fishler et al.

[11] Patent Number: 5,024,422

[45] **Date of Patent: * Jun. 18, 1991**

[54] ONE-PIECE STOPPER ROD

[75] Inventors: Mark K. Fishler, Tervuren; Jean-Marie Koten, Ostende, both of Belgium; Pascal Dubois, Feignies, France

[73] Assignee: Vesuvius Crucible Company, Pittsburgh, Pa.

[ * ] Notice: The portion of the term of this patent subsequent to Aug. 7, 2007 has been disclaimed.

[21] Appl. No.: 549,444

[22] Filed: Jul. 6, 1990

Related U.S. Application Data

[63] Continuation of Ser. No. 291,497, Dec. 29, 1988, Pat. No. 4,946,083.

[51] Int. Cl.[5] ..... B22D 11/10

[52] U.S. Cl. ..... 266/272; 222/597; 266/271; 164/415; 164/337; 164/437

[58] Field of Search ..... 164/337, 415, 437–439; 222/597–599, 602–603; 266/217, 271–272

[56] References Cited

U.S. PATENT DOCUMENTS

| | | | |
|---|---|---|---|
| 712,111 | 10/1902 | Allendorfer | 222/597 |
| 852,644 | 5/1907 | Bacon | 222/597 |
| 4,155,492 | 5/1979 | Seaton | 222/602 |
| 4,691,901 | 9/1987 | Dobner | 164/337 |
| 4,791,978 | 12/1988 | Fishler | 164/437 |
| 4,946,083 | 8/1990 | Fishler et al. | 164/337 |

FOREIGN PATENT DOCUMENTS

| | | | |
|---|---|---|---|
| 148452 | 11/1981 | Japan | 222/603 |
| 1168351 | 10/1969 | United Kingdom | 222/597 |

*Primary Examiner*—Richard K. Seidel
*Assistant Examiner*—Edward A. Brown
*Attorney, Agent, or Firm*—Webb Burden Ziesenheim & Webb

[57] ABSTRACT

A one-piece refractory stopper rod has an axial bore formed therein for the introduction of inert gas into molten steel within a tundish. A metal bushing insert is copressed into the refractory stopper rod and has a threaded bore which is positioned coaxially with the bore of the stopper rod body. A metal attachment rod having an axial bore therethrough and a threaded lower shank portion is secured within the threaded bore of the metal bushing insert. The metal attachment rod has an upper threaded shank which is adapted to be secured to a stopper rod lifting mechanism associated with the tundish. The metal rod further includes a flanged portion intermediate the upper and lower shank portions which carries an annular chamfered surface. The annular chamfered surface faces a like annular chamfered surface formed in the bore of the stopper rod to define a gas-tight seal at a sealing interface therebetween. The upper shank includes an internally threaded portion adapted to receive a threaded fitting for the introduction of a pressurized inert gas to the stopper rod bore. The attachment between the metal rod and the refractory stopper rod provides increased strength, while minimizing gas leakage and air infiltration compared to prior stopper rod attachment configurations.

12 Claims, 1 Drawing Sheet

ONE-PIECE STOPPER ROD

This is a continuation of co-pending application Ser. No. 07/291,497 filed on Dec. 29, 1988, now U.S. Pat. No. 4,946,038.

The present invention relates generally to stopper rods for controlling the flow of molten metal from a tundish and, more particularly, to a one-piece stopper rod which incorporates means for attaching the stopper rod to a lifting mechanism and for introducing an inert gas to the melt during continuous steel casting operations.

In the continuous casting of steel, it is well known to employ a one-piece refractory stopper rod for the control of molten metal flowing from the tundish to a water cooled mold. The stopper rod is moved vertically by the use of a lifting mechanism having rigging located adjacent the outside the tundish to control the volume of the molten metal flow. While the principle is quite simple, the working environment is very harsh. A refractory stopper rod must be able to withstand hours submerged in molten steel. It must also be capable of enduring the harsh thermal shock encountered on the start-up of casting and the buoyant forces imposed laterally by the molten steel and the resulting bending moments imparted at the attachment area between the refractory stopper rod and the refractory/metal connections.

In recent years, the one-piece stopper rod, in addition to controlling the flow of metal, has also been used to introduce an inert gas, such as argon, into the molten steel. Argon gas is useful in removing non-metallic inclusions from the molten metal resulting from the action of the gas bubbles as they float upwardly through the metal in the tundish. The argon gas also minimizes the formation of aluminum oxide in the pouring nozzle located beneath the tundish, which causes a clogging problem when casting aluminum killed steels.

It is often very difficult to obtain a gas-tight seal at the top of the stopper rod where it connects to the lifting mechanism. A gas-tight seal is important due to the fact that the flow of steel from the tundish to the casting mold creates a vacuum within the pouring system. This vacuum can draw air downwardly through the top of the stopper rod and then into contact with the molten metal, causing oxidation and subsequent reduction in the quality of the metal being cast. Proper injection of argon through an axial bore formed in the stopper rod tends to eliminate this potential problem by creating a positive pressure inside the stopper rod, assuming, of course, that the air leakage problem is not present.

In present-day steel making operations, the injection of argon through the bore of a one-piece stopper rod has become the industry standard for the continuous casting of steel. In order to meet the industry requirements, a number of stopper rod designs are presently utilized to inject argon into a tundish. Because of the critical nature of the stopper rod, both in terms of safety and steel quality, the quality of the refractory employed and the method of attachment to the stopper rod lifting mechanism are critical. Traditionally, one-piece stopper rods are attached by several well-known techniques. A common method of attaching a stopper rod to the lifting mechanism and inert gas line employs a ceramic threaded insert which is first fitted onto a flanged steel rod of the lifting mechanism. The ceramic insert is threadably secured within a threaded bore at the top of the one-piece stopper rod. The threaded bore at the top of the stopper rod is formed by isostatic pressing. There are a number of major disadvantages to this type of attachment system. The use of a ceramic insert results in a thin wall in the upper portion of the stopper rod, which weakens the structure and can frequently cause failure of the stopper rod due to breakage. In addition, it is nearly impossible to obtain a gas-tight seal between the stopper rod and this known ceramic insert. Finally, the assembly of stopper rods in the steel mill using this type of connection is quite time consuming and expensive.

A further known type of attachment utilizes a metal connector pin. In this attachment method, a hole is drilled horizontally through the stopper rod and the steel attachment rod of the lifting mechanism. The metal connector pin is placed through the stopper rod and the attachment rod to lock the rod in place. Unfortunately, in this type of assembly all of the mechanical forces applied during opening and closing of the stopper rod are exerted on the small cross-sectional area of the metal connector pin. This frequently leads to mechanical failure, while also proving very difficult, if not impossible, to obtain a gas-tight seal therewith.

A further type of attachment heretofore used in the industry employs a threaded bore isostatically pressed directly into an upper end of the stopper rod bore. A threaded steel rod is directly screwed into the stopper rod to form the attachment to the lifting mechanism of the tundish, as well as for the introduction of argon into the stopper rod bore. This type of attachment has never gained wide acceptance in the industry due to the high failure rate thereof. The failure usually results from cracking of the refractory stopper rod due to the higher thermal expansion coefficient of the steel in the threaded joint relative to the lower thermal expansion coefficient of the refractory material.

The present invention solves the problems heretofore experienced in attaching a one-piece stopper rod to a rigging for lifting the stopper rod and for supply of pressurized inert gas thereto. The invention provides a one-piece stopper rod which can be quickly and easily attached to the existing lifting mechanism and inert gas line, while affording greater mechanical strength and gas sealing performance over the presently known stopper rod attachment techniques used in the art. The invention provides less air infiltration into the cast metal than known systems, while also being more resistant to breakage and also easier to assemble at the mill site.

SUMMARY OF THE INVENTION

Briefly stated, the present invention comprises a one-piece refractory stopper rod of an elongated cylindrical shape and having upper and lower ends with an axial bore extending therethrough. The lower end may include a small diameter bore or a porous plug, or like means, formed therein which is in communication with the axial bore to supply a fine dispersion of inert gas to the melt, in a conventional manner. A metal bushing insert, preferably of stainless steel, is isostatically pressed into the refractory stopper rod during the manufacturing process. The metal bushing insert has an outer sidewall carrying a series of spaced-apart ribs to provide a mechanical interlock with the refractory material during copressing and firing. The bushing insert also has a threaded internal bore which is coaxially aligned with the bore of the stopper rod. The bushing insert is spaced downwardly from the upper surface of the stopper rod to provide additional pull-out strength. The upper end of the bore of the stopper rod has an enlarged countersunk bore area with an annular chamfered sealing surface extending between the enlarged countersunk bore and the main bore of the stopper rod. A steel rod is provided to serve as an attachment means between the refractory stopper rod and the lifting mechanism of the tundish rigging. The steel rod also serves to provide a gas-tight seal in the refractory stopper rod. More particularly, the steel rod comprises an elongated rod shaped member, having an upper threaded shank area and a lower threaded shank area with an axial bore extending therethrough. Intermediate the upper and lower shank areas, is an enlarged flanged portion having an annular chamfered surface extending inwardly therefrom which is adapted to match the surface contour of the annular chamfered surface of the stopper rod bore. In use, the lower threaded shank portion of the steel rod is threadably secured within the threaded bore of the metal bushing insert of the stopper rod. In a fully torqued, seated position, the chamfered surface of the steel rod closely faces the matching chamfer of the stopper rod bore at the countersunk area to form a gas-tight seal therebetween. Preferably, a ring-shaped gasket means, such as a high temperature graphite washer, may be interposed between the chamfered surfaces of the steel rod and ceramic stopper rod to provide an improved gas impervious seal. A metal locking ring is placed around the upper threaded shank portion of the rod member and bears against the upper end of the stopper rod. A nut is threadably secured around the upper shank area to compressibly engage the locking ring and force the ring against the stopper rod to provide a firm mechanical grip between the metal rod and the embedded metal bushing insert of the ceramic stopper rod. The axial bore of the steel rod has an internally threaded bore section at its upper end which is adapted to be attached to a threaded fitting of a inert gas supply line. Pressurized inert gas is introduced into the axial bore of the steel rod and emitted to the bore of the stopper rod for subsequent release into the molten metal through the restricted delivery bore or like porous means formed at the lower end of the stopper rod. The end of the upper shank above the locking ring and nut is then secured to the lifting mechanism in a conventional manner.

DETAILED DESCRIPTION OF THE INVENTION

Figure 1:
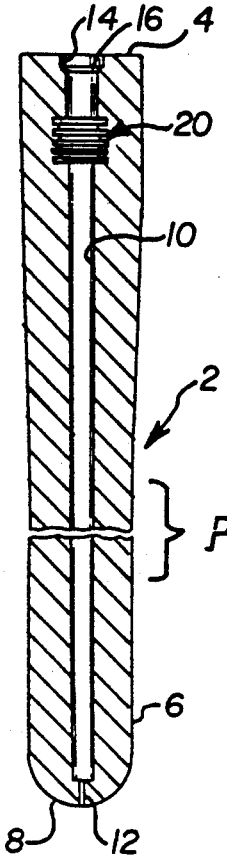
FIG. 1 is a partial, cross-sectional, side elevational view of a stopper rod and co-pressed metal bushing insert of the present invention.

A one-piece stopper rod according to the present invention is depicted in FIG. 1 and identified by reference numeral 2. The stopper rod 2 comprises a refractory body which is generally cylindrical in shape, having an upper end 4 and a lower end 6, with an axial bore 10 extending from the upper to lower ends. A smaller diameter bore 12 communicates with the bore 10 at the lower end thereof and extends outwardly to meet a hemispherically shaped seating surface 8 formed at the lower end thereof. Surface 8 is adapted to engage a seating surface at the bottom of a tundish to seal off a metal discharge port in the bottom of the tundish (not shown) when the stopper rod 2 is in a lowered position. When the stopper rod is raised by a suitable lifting mechanism (not shown), molten metal flows past the seating surface 8 and is permitted to flow from the tundish to a continuous casting mold positioned therebelow (not shown). A pressurized inert gas, such as argon, is introduced to the axial bore 10 of the stopper rod to be discharged from the lower end of the stopper rod through the smaller diameter delivery bore 12. Other conventional gas delivery means may be employed, such as, for example, a separately formed porous plug or a gas permeable nose section, as disclosed in U.S. Pat. No. 4,791,978 to Mark K. Fishler.

A typical stopper rod 2 has a length of about 1450 mm (4.75 feet) and an outside diameter at the upper end 4 of about 150 mm (6 inches) which tapers to a diameter of about 127 mm (5 inches) at the lower end 6. A typical dimension for the axial bore diameter 10 is about 34 mm (1.33 inches), for example. The stopper rod 2 is formed from a conventional refractory material such as, for example, an alumina-silica-graphite refractory material commonly used in commercial stopper rods. A typical composition for the stopper rod 2 in percent by weight is, for example, 53% $Al_2O_3$; 13% $SiO_2$ and 31% carbon in the form of graphite, and about 3% other materials, including materials such as zirconia, $ZrO_2$, for example.

Figure 2:
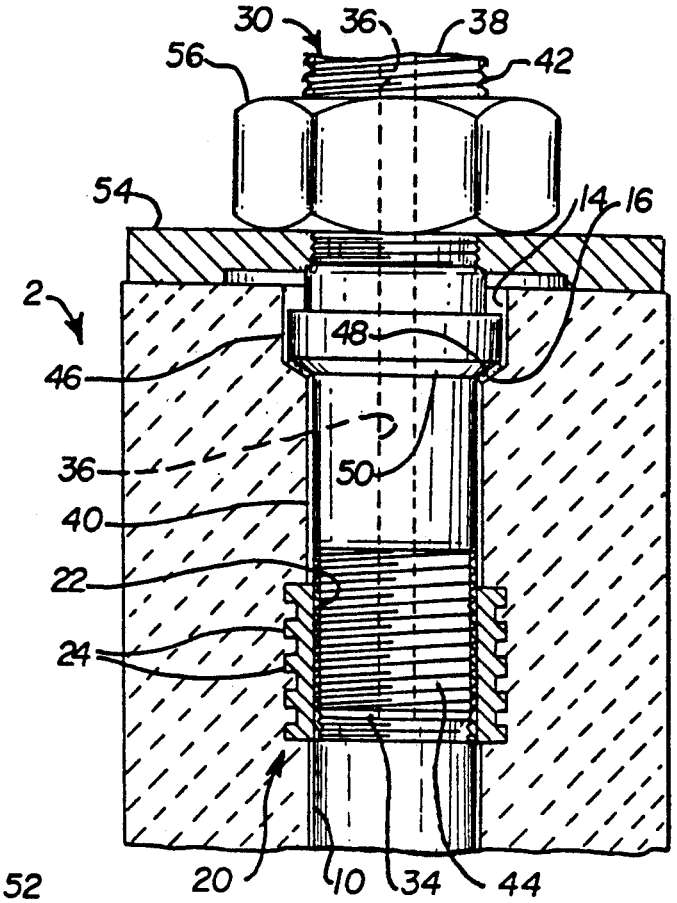
FIG. 2 is an enlarged, fragmentary, cross sectional side view of the upper end of the stopper rod, copressed metal bushing insert and metal rod connection, according to the present invention.

The stopper rod 2 of the present invention includes a metal bushing insert 20 which is isostatically copressed and fired along with the refractory stopper rod such that in the fired state, the metal bushing insert 20 is integrally joined with the refractory material positioned substantially coaxially with the bore 10 thereof as shown in FIGS. 1 and 2. The insert 20 is preferably constructed of a stainless steel material and, more preferably, type 309 stainless steel. Stainless steel has a lower thermal expansion coefficient than carbon steels, while also possessing a good resistance to the high temperatures and reducing conditions commonly found in the environment of a stopper rod, while being relatively inexpensive. The metal bushing insert 20 is spaced from the upper surface 4 of the stopper rod a distance of at least about 50 mm (2 inches) in order to increase the pull-out strength of the bushing. The bushing insert 20 is shaped in the form of an open-ended cylinder, having an internally threaded bore 22 which, as previously stated, is positioned coaxially with the bore 10 of the stopper rod. The bushing insert 20 also has a plurality of outwardly projecting fin means defined by alternating grooves and ridges 24 formed around the outer sidewall thereof, which serve to enhance the mechanical interlock between the bushing insert 20 and the ceramic refractory stopper rod 2. The grooves and ridges 24 are machined on the outside of the bushing 20, and have a depth of about 4 mm. The grooves and ridges 24 are spaced apart about 10 mm along the length of the bushing 20. Due to the fact that the grooves and ridges 24 do not have to be large, a relatively small diameter bushing, on the order of about 40 to 70 mm (1.5 to 2.75 inches), can be used. This feature yields a relatively thick wall of refractory material at the upper end 4 of the stopper rod body to provide additional strength when the stopper rod is moved vertically to control the flow of molten steel within the tundish. There is also a large bending moment constantly acting on the stopper rod due to its natural buoyancy when submerged in a bath of molten steel. The increased refractory wall thickness provided by the relatively small metal bushing insert 20 also helps to resist this bending moment. In addition, the fact that the bushing 20 is positioned well below the upper surface 4 of the stopper rod by a minimum distance of about 50 mm, also increases the resistance to pull-out when the bushing is in its assembled state with the metal mounting rod 30, as will be explained hereinafter.

Figure 3:
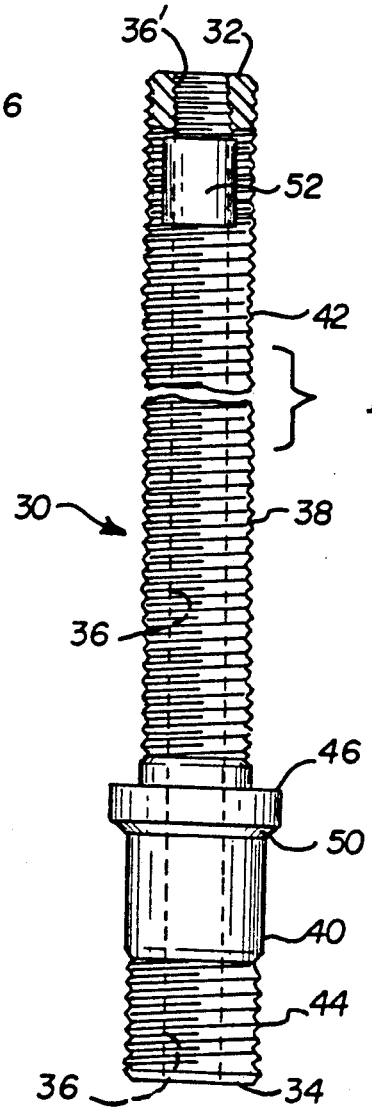
FIG. 3 is a side elevational view, partially fragmented, of a metal rod suitable for use in connection with the present invention.

The steel bushing insert 20 is adapted to receive a metal rod 30 which is shown in FIGS. 2 and 3. Metal rod 30 is preferably machined from a steel bar and comprises an upper end 32 and a lower end 34 with an upper shank portion 38 and a lower shank portion 40. The upper shank portion 38 has external threads 42 formed thereon, while the lower shank portion 40 carries external threads 44 thereon. An enlarged flanged portion 46 is positioned between the upper and lower shank portions and includes an annular, tapered, chamfered surface 50 formed thereon, whose purpose will be explained hereinafter.

The steel rod 30 also has an axial bore 36 formed therethrough extending from the upper end 32 to the lower end 34. The bore 36 contains an internally threaded portion 36' at its upper end, which is adapted to receive a threaded fitting (not shown) for the introduction of pressurized inert gas therein. The upper shank portion 38 also preferably contains a pair of oppositely disposed flat surface segments machined therein to provide a gripping surface for a wrench to permit the steel rod 30 to be threadably secured and torqued within the metal insert 20.

As seen in greater detail in FIG. 2, the steel rod 30 is threadably secured by way of threads 44 at the lower shank portion 40 within the threaded bore 22 of the insert bushing 20. When the rod 30 is sufficiently torqued within the bushing 20, the chamfered surface 50 moves into close engagement with a similarly formed countersunk and annular chamfered surface formed by portions 14 and 16, respectively within the upper portion of the bore 10 of the stopper rod body 2. The area between the chamfered surface 50 and the chamfered surface 16, preferably contains a ring-shaped gas sealing gasket 48 which is constructed of a high temperature material, such as, for example, graphite. The gasket 48, has a thickness of about 0.4 mm. With gasket 48 in place, we have found that the interface between surfaces 50 and 16 provides a gas-tight seal capable of withstanding gas pressures of up to 3 bars. In the torqued position, the seal between the respective chamfered surfaces 50 and 16, prevents air and inert gas leakage therebetween and thus provides protection against air infiltration and subsequent harmful oxidation of the cast steel which is quite prevalent in the prior art stopper rod designs.

The steel rod 30 is secured against rotation within the stopper rod 2 by way of a ring-shaped locking or clamping ring 54 which is fitted around the upper shank portion 38 of the steel rod and firmly held against the upper surface 4 of the stopper rod by way of a nut 56, which is threadably fitted around the threads 42 of the steel rod.

The upper shank portion 38 of the steel rod extending above the nut 56 is attached to the rigging of a lifting mechanism (not shown) in a conventional manner. Inert gas under pressure is introduced into the steel rod at internally threaded bore segment 36' and flows through the bore 36 of the steel rod whereupon it is introduced into the axial bore 10 of the refractory stopper rod body for subsequent delivery into the molten metal by way of the restricted orifice 12, or by some other conventional gas dispersion means such as a gas permeable nose section, porous plug or the like, as previously discussed.

The diameter of the lower shank portion 40 of the steel rod 30 closely matches the diameter of the bore of the stopper rod as seen in FIG. 2, so as to yield a close tolerance fit therein and provides improved mechanical strength in the assembly. Normally, the steel rod 30 has a diameter within the range of about 25 to 55 mm (1–2.165 inches). Maximum strength is obtained when the steel rod is threaded into the bushing 20 a distance of at least 1.5 times the diameter of the steel rod. Therefore, allowing for extra length, the bushing insert 20 preferably has a length of at least about 2 times greater than the steel rod 30 diameter. Accordingly, a length of at least about 50 to 100 mm (2–4 inches) is preferred for the metal bushing insert 20. We have also found that when the chamfered surfaces 50 of the steel rod and 16 of the refractory body 2 have an angular inclination of about 30° relative to a plane passing perpendicularly through the axes of the bores 10 and 36, respectively, an excellent gas-tight interface is formed therebetween.

In actual testing at a steel mill, 40 one-piece stopper rods 2, according to the invention, each having a co-pressed steel insert 20 and steel rod 30 attached thereto, were employed in casting trials utilizing a 250 ton ladle size and a 50 ton tundish size. A 5 ladle sequence pour with an average casting time per sequence of 5 hours was undertaken using a deep drawing steel and a low alloy steel. The 40 test pieces of the invention performed without any problems. The average nitrogen pick up between the tundish and the continuous casting mold was, on the average, about one part per million lower than the steel cast with the traditional stopper rod connections. The stopper rods were mounted and dismounted a number of times and were found to be considerably easier to handle than the traditional stopper rod connection mounts. The one-piece stopper rod and steel connecting rod of the present invention were found to be very easy to assemble on site, and were very safe in use.

What is claimed is:

1. A stopper rod adapted for attachment to a lifting mechanism adjacent to a metallurgical vessel, comprising:

an elongated stopper rod body of a pressed and fired refractory material having an upper end and a lower end, and having an axial bore extending from the upper end toward said lower end; and a metal bushing insert co-pressed and fired within the stopper rod body in a spaced relationship adjacent said upper end, said insert having a threaded bore positioned co-axially with the bore of the stopper rod body and adapted to threadably receive a threaded metal rod for attachment to said lifting mechanism.

2. The stopper rod of claim 1 wherein the metal bushing insert has an outer sidewall surface carrying means for providing a mechanical interlock between the metal bushing insert and the refractory material of the stopper rod body.

3. The stopper rod of claim 2 wherein the mechanical interlock means is a plurality of alternating grooves and flanges.

4. The stopper rod of claim 1 wherein the metal bushing insert is spaced a distance from the upper end of the stopper rod body to increase to pull-out strength of said bushing insert and the stopper rod body has an enlarged countersunk bore at the upper end which includes an annular surface joining the bore of the body wherein said annular surface is adapted to seat against a like annular surface carried by the metal rod attached to the lifting mechanism.

5. The stopper rod of claim 1 wherein the refractory material of the stopper rod body contains a graphite constituent and wherein the metal bushing insert is constructed of a stainless steel material.

6. A stopper rod for use in the continuous casting of steel from a metallurgical vessel comprising in combination:

an elongated stopper rod body of a pressed and fired refractory material, having an upper end and a lower end and an axial bore extending from the upper end toward the lower end, said axial bore including an enlarged countersunk portion having an annular surface spaced from the upper end thereof;

a metal bushing insert co-pressed and fired within the stopper rod body in a spaced relationship adjacent the upper end thereof, said bushing insert having a threaded bore positioned coaxially with the bore of the stopper rod body;

an elongated metal rod having a threaded lower shank portion which is secured within the threaded bore of the metal bushing insert, said metal rod also including an upper shank portion and a flanged portion carrying an annular surface intermediate said upper and lower shank portions, said annular surface facing said annular surface of the stopper rod bore to define a seating interface therebetween; said upper shank portion adapted to be secured to a lifting mechanism to permit the stopper rod to be vertically moved within the metallurgical vessel; and locking means secured to the upper shank portion of the metal rod engaging the upper end of the stopper rod to prevent relative rotation between the metal rod and the stopper rod.

7. The stopper rod of claim 6 wherein the metal rod includes flat-sided gripping means formed on the upper shank portion to permit torquing of said lower shank portion within the threaded bore of the metal bushing insert.

8. The stopper rod of claim 6 wherein the refractory material of the stopper rod body contains a graphite constituent and wherein the metal bushing insert is constructed of stainless steel.

9. The stopper rod of claim 8 wherein the metal bushing insert is constructed of type 309 stainless steel.

10. The stopper rod of claim 6 wherein the metal bushing insert is spaced from the upper end of the stopper rod at a distance of at least two inches.

11. The stopper rod of claim 6 wherein the metal bushing insert has an axial length at least 1.5 times greater than a diameter of the lower shank portion of said metal rod.

12. The stopper rod of claim 6 wherein the annular seating surfaces of the metal rod and refractory stopper rod are chamfered surfaces.

* * * * *

UNITED STATES PATENT AND TRADEMARK OFFICE

CERTIFICATE OF CORRECTION

PATENT NO. : 5,024,422

DATED : June 18, 1991

INVENTOR(S) : Mark K. Fishler, Jean-Marie Koten and Pascal Dubois

It is certified that error appears in the above-identified patent and that said Letters Patent is hereby corrected as shown below:

Column 1 Line 6 "4,946,038" should read --4,946,083--.

Column 3 Line 39 "a inert" should read --an inert--.

Column 6 Line 22 after "and" delete --16--.

Claim 4 Line 3 Column 7 "increase to" should read --increase a--.

Signed and Sealed this

Twenty-fourth Day of November, 1992

*Attest:*

DOUGLAS B. COMER

*Attesting Officer*

*Acting Commissioner of Patents and Trademarks*